US011840931B2

(12) United States Patent
De Rinaldis et al.

(10) Patent No.: US 11,840,931 B2
(45) **Date of Patent: *Dec. 12, 2023**

(54) RECOMPRESSED TRANSCRITICAL CYCLE WITH POST-EXPANDING IN CRIOGENIC- OR LOW-TEMPERATURE APPLICATIONS, AND/OR WITH COOLANTS

(71) Applicant: SAIPEM S.P.A., San Donato Milanese (IT)

(72) Inventors: Salvatore De Rinaldis, San Donato Milanese (IT); Massimiliano Sbarsi, San Donato Milanese (IT); Lucio Aurilio, San Donato Milanese (IT); Anton Marco Fantolini, San Donato Milanese (IT)

(73) Assignee: SAIPEM S.P.A., San Donato Milanese (IT)

( * ) Notice: Subject to any disclaimer, the term of this patent is extended or adjusted under 35 U.S.C. 154(b) by 125 days.

This patent is subject to a terminal disclaimer.

(21) Appl. No.: 17/599,764

(22) PCT Filed: Mar. 19, 2020

(86) PCT No.: PCT/IB2020/052524

§ 371 (c)(1),
(2) Date: Sep. 29, 2021

(87) PCT Pub. No.: WO2020/201877

PCT Pub. Date: Oct. 8, 2020

(65) Prior Publication Data

US 2022/0154593 A1 May 19, 2022

(30) Foreign Application Priority Data

Mar. 29, 2019 (IT) ..... 102019000004733

(51) Int. Cl.
*F01D 15/10* (2006.01)
*F01D 25/10* (2006.01)

(52) U.S. Cl.
CPC ..... *F01D 15/10* (2013.01); *F01D 25/10* (2013.01)

(58) Field of Classification Search
CPC ..... F01D 15/10; F01D 25/10; F01K 25/10; F01K 7/06; F01K 19/02
(Continued)

(56) References Cited

U.S. PATENT DOCUMENTS 4,624,109 A * 11/1986 Minovitch ..... F01K 25/10 60/648
2004/0250556 A1* 12/2004 Sienel ..... F25B 9/008 62/498

(Continued)

FOREIGN PATENT DOCUMENTS

DE 202007012871 U1 11/2007
WO 2008101711 A2 8/2008
WO 2015124325 A1 8/2015

OTHER PUBLICATIONS

U.S. Appl. No. 17/598,773, Sbarsi et al, filed Jun. 2022 (Year: 2022).*

(Continued)

*Primary Examiner* — Hoang M Nguyen
(74) *Attorney, Agent, or Firm* — Armstrong Teasdale LLP

(57) ABSTRACT

A process for regasifying a fluid and producing electrical energy includes subjecting a working fluid to 1) high-pressure pumping, 2) heating in a recovery unit to obtain a heated flow, the heating step comprising a low-temperature heat recovery step 2a) and a high-temperature heat recovery step 2b), 3) further heating to obtain a further heated flow, 4) expanding in a turbine, with production of electrical energy, to obtain an expanded flow, 5) cooling in a recovery (Continued)

unit by heat exchange, in a step 5a) with the flow of step 2b) and in a step 5b) with the flow of step 2a) to obtain a cooled flow, 6) expanding with production of mechanical energy, and 7) condensing the flow of working fluid. After step 5), a portion of the flow of working fluid is not subjected to step 6) and is subjected to a recompressing step.

9 Claims, 5 Drawing Sheets

(58) Field of Classification Search
USPC ..... 60/651, 653, 671, 677–679
See application file for complete search history.

(56) References Cited

U.S. PATENT DOCUMENTS

| | | | | |
|---|---|---|---|---|
| 2016/0010513 | A1* | 1/2016 | Kang | F01K 7/32<br>60/671 |
| 2022/0186884 | A1* | 6/2022 | Sbarsi | F22B 3/08 |

OTHER PUBLICATIONS

International Search Report and Written Opinion, issued in PCT/IB2020/052524, dated Jul. 29, 2020, 10 pages.

* cited by examiner

RECOMPRESSED TRANSCRITICAL CYCLE WITH POST-EXPANDING IN CRIOGENIC- OR LOW-TEMPERATURE APPLICATIONS, AND/OR WITH COOLANTS

CROSS-REFERENCE TO RELATED APPLICATIONS

This application is a U.S. National Phase filing of PCT International Patent Application No. PCT/IB2020/052524, having an international filing date of Mar. 19, 2020, which claims priority to Italian Patent Application No. 102019000004733, filed Mar. 29, 2019, each of which is hereby incorporated by reference in its entirety.

TECHNICAL FIELD OF THE INVENTION

The present invention applies to the energy field, in particular for improving the energy efficiency of liquefied natural gas regasification systems.

BACKGROUND ART

Technologies are known for regasifying liquefied gases, such as for example, liquefied natural gas (LNG).

The liquefied natural gas is a mixture of natural gas mainly consisting of methane and, to a lesser extent, of other light hydrocarbons, such as for example, ethane, propane, iso-butane, n-butane, pentane, and nitrogen, which is converted from the gaseous state, in which it is at ambient temperature, to the liquid state, at about −160° C., to allow the transport thereof.

Liquefaction systems are located close to natural gas production sites, while regasification systems (or "regasification terminals") are located close to the users.

Most of the systems (about 85%) is located onshore, while the remaining part (about 15%) is located offshore on platforms or ships.

It is common for each regasification system to comprise several regasification lines in order to meet the liquefied natural gas load or requirements, as well as for reasons of flexibility or technical need (for example, for line maintenance).

Usually, regasifying technologies involve liquefied natural gas stored in tanks at atmospheric pressure at the temperature of −160° C. and comprise the steps of compressing the fluid up to about 70 to 80 bar and vaporization and superheating up to about 3° C.

The thermal input required for regasifying 139 t/h (base load system) is about 27 MWt, while the electric one is about 2.25 MWe (4.85 MWe if the other auxiliary loads of the system are considered; maximum 20 MWe electric load of the system on 4 regasification lines in operation).

The most used regasifying technologies, individually or combined with each other, comprise the Open Rack Vaporizer (ORV) technology, employed in about 70% of the regasifying terminals (in the world), and the Submerged Combustion Vaporizer (SCV).

Other technologies employ the Intermediate Fluid Vaporizer (IFV) or the Ambient Air Vaporizer (AAV).

Open Rack Vaporizer (ORV)

This technology provides for the natural gas in the liquid state (about 70 to 80 bar and at the temperature of −160° C.) to be caused to flow from the bottom upwards in aluminum pipes placed side-by-side to form panels; the vaporization occurs progressively as the fluid proceeds.

The heat carrier is seawater which flowing from the top downwards over the outer surface of the pipes, provides the heat required for the vaporization by difference in temperature.

In particular, the heat exchange is optimized by the design of the profile and the surface roughness of the pipes, which create a homogenous distribution of the thin seawater film over the panel.

Submerged Combustion Vaporizer (SCV)

Such a technology exploits a demineralized waterbath heated by an immersed flame burner as heat carrier; the Fuel Gas (FG) in particular is burned in the combustion section and the fumes generated pass through a coil of perforated pipes from which the combusted gas bubbles leave, which combusted gas bubbles heat the waterbath by also yielding the condensation heat.

The liquefied natural gas (LNG) vaporizes in another coil of stainless-steel pipes immersed in the same demineralized and heated waterbath.

The same water of the bath is kept in circulation in order to ensure a homogenous temperature distribution.

The exhausted fumes instead are discharged from the exhaust gas stack of the SCVs.

Organic Rankine Cycle

The Organic Fluid Rankine Cycles (ORCs) are widely used in the geothermal field and for biomass applications or for Waste Heat Recovery from industrial processes.

Such cycles provide the possibility of selecting the working fluid among a broad variety of candidate fluids and allows efficient thermodynamic cycles to be obtained, also for low temperatures of the heat source and for little availability of thermal energy.

Further, the selection of a low boiling fluid allows a condensing cycle at cryogenic temperatures to be achieved without running into problems of freezing or ultra-high vacuum degrees.

Drawbacks of the Submerged Combustion Vaporizer (SCV) and Open Rack Vaporizer (ORV) Technologies The (SCV) technology results in a consumption of fuel gas equal to about 1.5% of the processed gas and produces carbon dioxide which lowers the pH of the waterbath, requiring treatments with caustic soda and thus causing an emission of $CO_2$ into the atmosphere of about 50,000 t/year in order to regasify 139 t/h of LNG.

With regard instead to the Open Rack Vaporizer (ORV), such a technology may partly cause the freezing of the seawater in the outer part of the pipes, especially in the sections in which the LNG is colder; further: i) it may be exploited in the geographical regions and/or in the seasons in which the temperature of the seawater is at least 5 to 9° C., mainly represented by the subtropical areas, ii) the seawater is to be processed beforehand to eliminate or reduce the content of the heavy metals which could corrode the zinc covering of the pipes, iii) it results in a consumption of electrical energy for operating the pumps for the seawater which is to exceed a geodetic difference of level equal to the development in height of the ORVs with additional consumptions of about 1 MWe per regasification line with respect to the SCV technology (requiring a total power of about 20 MWe for a system with four regasification lines of 139 t/h each), iv) it results in an environmental impact in returning the colder and processed seawater, v) lastly, the technology is rather complex and available at a limited number of suppliers and sizes.

A transcritical power production cycle which employs $CO_2$ is depicted in FIG. 1.

Such a cycle does not take into consideration the employment of the LNG frigories, neither directly nor by means of other intermediate fluids, with the following limitations:

- given the critical temperature of the $CO_2$ (30.98° C.), if, as in literature, it is considered that the cycle employs a cold source at the ambient temperature (air or cooling water coolers), such a power cycle extends with effort to the step transition, i.e. at the condensation temperatures of $CO_2$ to develop a transcritical cycle (Rankine-Brayton). Further, this does not allow a reasonable system stability:
- given the high critical pressure of the $CO_2$ (73.8 bar A), the benefits due to the high temperature and input pressure to the expansion turbine are reduced by the smaller maximum expansion ratio attainable, and therefore by the power which can be extracted from the cycle;
- also having a cold well at lower temperature and desiring to exploit a very high maximum pressure (up to 300 bar A), the employment of a condensation pressure less than about 50 bar A (and therefore a condensation temperature less than 15° C.) would result in a much greater complexity of the (inter-refrigerated multi-stage) recompressor due to the too high compression ratio;
- the systems operating with gaseous steps alone require significant storage volumes to manage the circulating flows.

In the case of an unrecovered supercritical/transcritical $CO_2$ topping cycle, the recovery unit which lowers the temperature of the $CO_2$ to the benefit of the efficiency of the cycle itself is not output from the $CO_2$ turbine; therefore, $CO_2$ still at a relatively high temperature is the thermal input for the ORC bottoming cycle.

Using an unrecovered $CO_2$ cycle therefore means not extracting mechanical energy in an efficient manner from a system which with a recovery unit or recompressor, potentially would be more efficient.

The thermal energy not used in the $CO_2$ cycle is sent to the ORC bottoming cycle, which would operate with a significant difference in temperature and therefore, an increased pressure ratio, making difficult the design of turbomachinery, to the benefit of a moderate increase in efficiency with respect to a $CO_2$ system.

Therefore, in general, the conventional and/or already known technologies do not allow the electrical energy required for the system to be produced and result in the loss of a large quantity of energy in the form of frigories.

SUMMARY OF THE INVENTION

The inventors of the present patent application surprisingly have found that a power generatio cycle may be configured which employs a working fluid that may be employed for regasifying LNG, thus producing enough electrical energy to operate the system.

OBJECT OF THE INVENTION

Therefore, a first object of the invention is a process for regasifying a fluid and for producing electrical energy.

A second object describes a regasification line of the liquefied gas which allows producing electrical energy by exploiting the process of the invention, and a system comprising such a line.

DETAILED DESCRIPTION OF THE INVENTION

Figure 1:
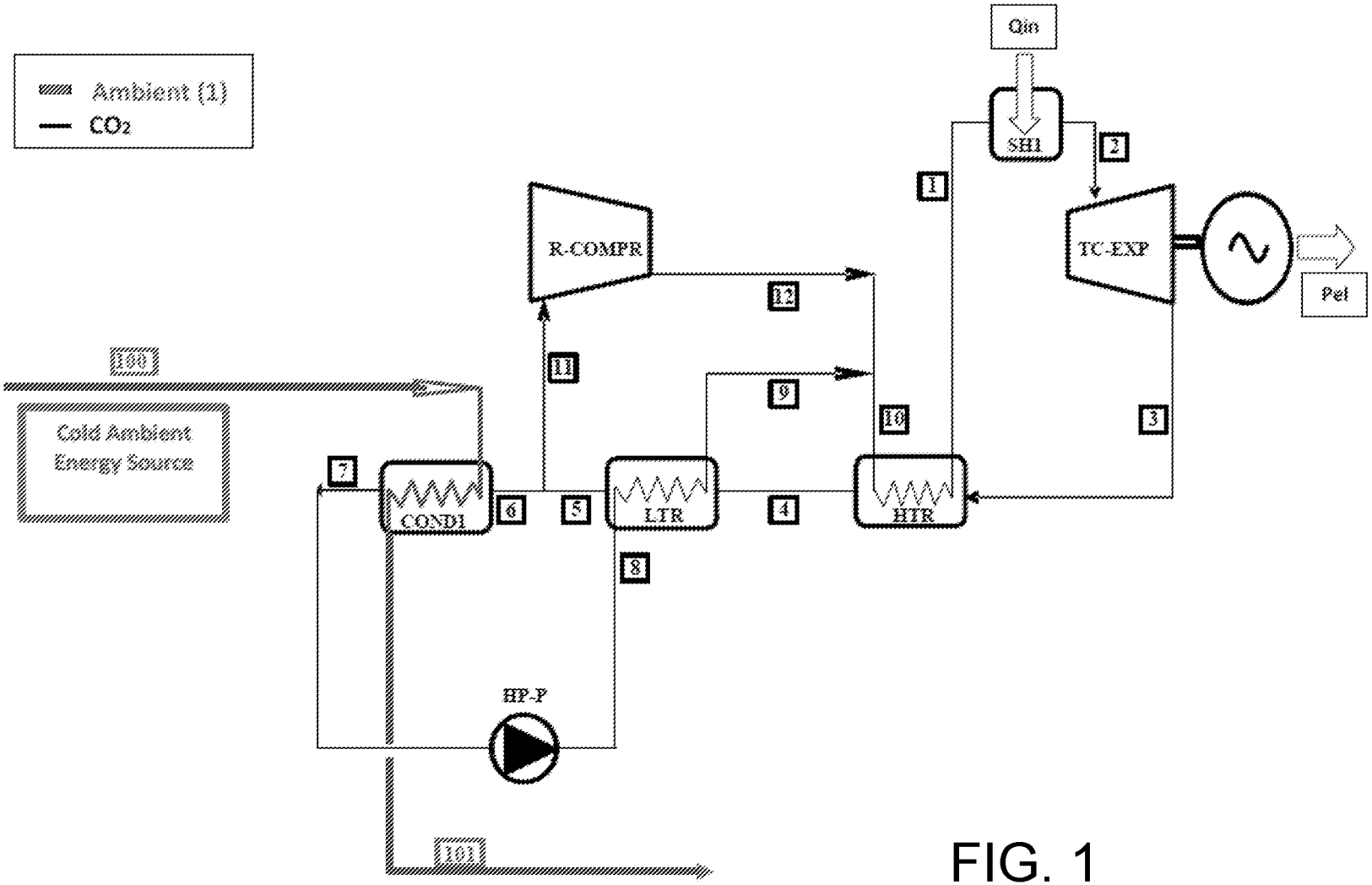
FIG. 1 shows the diagram of a Brayton Cycle under transcritical conditions according to the background art, which exploits environmental fluid as a cold source for the liquefaction of the $CO_2$.

The present invention in particular is described in relation to regasifying liquefied natural gas (LNG), but it is equally applicable for regasifying or the vaporization of other liquefied fluids stored at low temperatures (lower than about 0° C.) or at cryogenic temperatures (lower than −45° C.)

The present invention for example, is applied for regasifying a liquefied gas selected from the group which comprises for example: air, nitrogen, commercially available hydrocarbon compounds such as alkanes, among which for example, propane and butane, or alkenes, among which for example, ethylene and propylene.

The terms "evaporation" and "vaporization" applicable to LNG are to be intended as synonyms in the continuation of the description.

Further, "liquefied natural gas", later also called "liquefied gas", in the present description means a liquid obtained from natural gas after suitable refining and dehydrating processes and successive cooling and condensation steps.

More generally, "liquefied gas" in the present description means a fluid having a mainly liquid component.

Further, the term "low-temperature heat source" in the present description means for example: ambient air, seawater, low-temperature solar thermal, exhaust heat of a low-temperature thermodynamic cycle, low-temperature process and/or machinery heat recovery.

A low-temperature source generally operates at temperatures which are lower than 180° C., preferably lower than 120° C.

The term "high-temperature heat source" instead means for example: high-temperature thermal solar, exhaust heat of a high-temperature thermodynamic cycle, exhaust gas of a gas turbine or internal combustion engine, high-temperature process and/or machinery heat recovery.

A high-temperature source generally operates at temperatures which are greater than 180° C., preferably greater than 300° C., and even more preferably greater than 400° C. and beyond.

For the purposes of the present invention, it may be provided for a same low- or high-temperature heat source to feed several heating systems.

In the following description, the term "seawater" refers not only to seawater which is pumped and suitably processed to remove sediments and conveniently pumped (for example at about 2 bar), but more generally, environmental water obtained from rivers, canals, wells, natural basins such as lakes, etc. and artificial basins.

For the purposes of the present invention, the working fluid is $CO_2$.

For the purposes of the present invention, an intermediate working fluid is a fluid capable of carrying out a heat transfer from one cycle to another.

Such an intermediate working fluid may for example, carry out a heat transfer from a first power cycle (to which reference may be made as topping cycle) to a second power cycle (to which reference may be made as bottoming cycle).

In one aspect of the invention, the bottoming cycle is a power cycle equal to the topping cycle.

In a preferred aspect, the intermediate working fluid is different from the working fluid of the topping cycle.

For the purposes of the present invention, a working fluid is involved which is different from $CO_2$ and preferably is a gas or a gas mixture selected from the group comprising: hydrocarbons, nitrogen, $CO_2$ and coolants.

According to a first object, the present invention describes a process for regasifying a fluid and for producing electrical energy.

As described above, such a fluid preferably is liquefied natural gas (LNG).

In a particular aspect of the present invention, the process comprises the employment of a working fluid, which preferably is $CO_2$.

More specifically, the process comprises the steps of subjecting said working fluid to the steps of:

1) high-pressure pumping,
2) heating in a recovery unit, thus obtaining a heated flow,
3) heating through a high-temperature source, obtaining a further heated flow,
4) expanding in a turbine, with production of electrical energy (through a generator), thus obtaining an expanded flow,
5) cooling in a recovery unit, thus obtaining a cooled flow,
6) expanding with the production of mechanical energy,
7) condensing said flow of the working fluid and regasifying said fluid.

For the purposes of the present invention, step 1) increases the pressure up to beyond 150 bar.

With regards to step 2), it comprises a low-temperature heat recovery step 2a) (LTR) and a high-temperature heat recovery step 2b) (HTR).

More specifically, step 2a) increases the temperature up to about 200° C.

For the purposes of the present invention, step 5) is carried out in the same recovery unit as step 2); indeed, the heat exchange of step 5) is carried out with the flow of step 2b) (high-temperature recovery or step 5a)) and 2a) (low-temperature recovery or step 5b), respectively, and allows a cooled flow to be obtained.

For the purposes of the present invention, after step 5), and more specifically step 5b), a portion of the flow of the working fluid is not subjected to the expansion step 6), rather is subjected to a recompressing step.

A recompressed flow of working fluid is obtained from the recompressing step, which is then combined with the flow obtained from step 2a) and subjected to the subsequent steps of the process.

With regards to the heating step 3), it is carried out by means of a high-temperature heat source.

According to a preferred aspect of the present invention, the working fluid is $CO_2$ and such an expansion step 4) is therefore a supercritical or transcritical expansion step.

Electrical energy is produced with step 4).

For the purposes of the present invention, step 6) to which a portion of the working fluid is subjected, is a subcritical expansion step.

With reference to the condensation step 7), it is carried out by heat exchange with the fluid to be regasified.

Figure 2A:
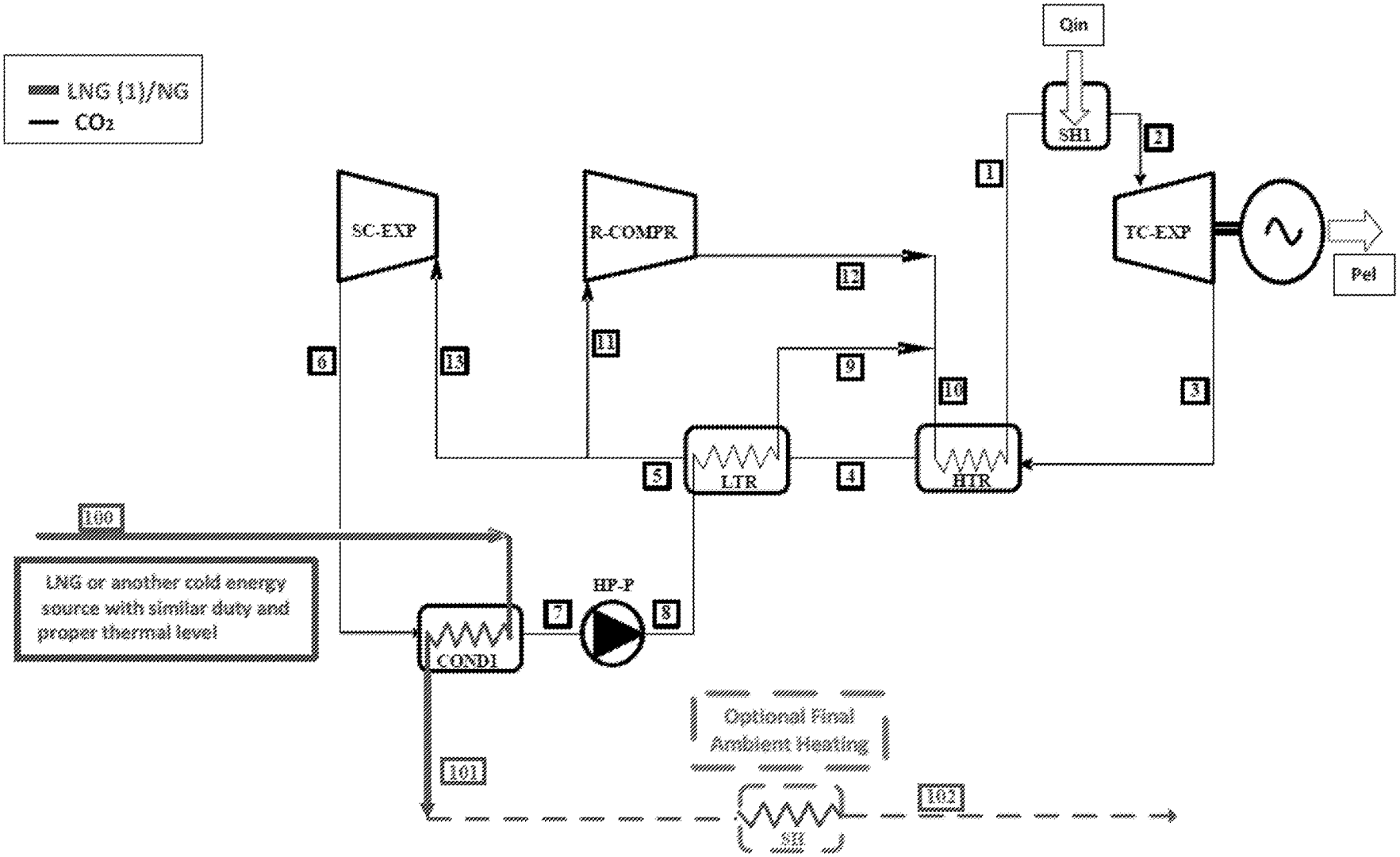
FIG. 2A shows the diagram of an embodiment of the process of the present invention and, in FIG. 2B, a variant thereof comprising a bottoming cycle.

According to a first aspect of the invention depicted for example, in FIG. 2A, the heat exchange between the working fluid flow and the fluid to be regasified is direct.

Figure 2B:
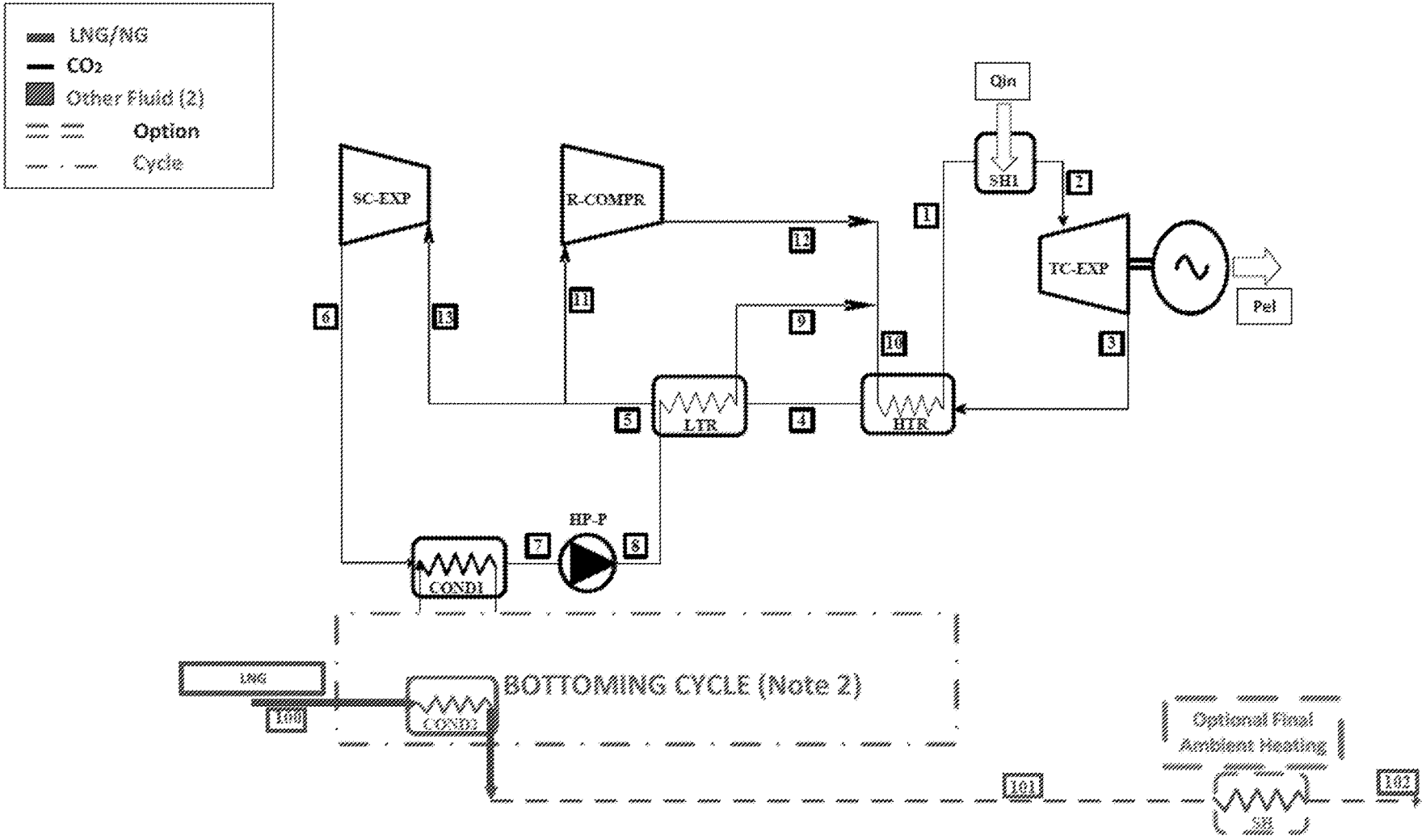
FIG. 2C depicts a variant for actuating the recompressor applied to the diagram in FIG. 2A.

According to an alternative embodiment of the present invention depicted in FIG. 2B, the condensation step 7) is carried out by indirect heat exchange between the working fluid and the fluid to be regasified.

More specifically, such an indirect exchange occurs by means of an intermediate working fluid, as described above.

Such an intermediate working fluid circulates within a cycle, called bottoming cycle.

More in detail, said bottoming cycle comprises a first exchanger COND1 (which corresponds to the condenser of step 7) and which is the condenser of the topping cycle), inside of which the heat exchange is carried out between the working fluid and said intermediate working fluid which is thus heated, and a second exchanger COND2, inside of which the heat exchange is carried out between the intermediate working fluid and the fluid to be regasified, to which heat is yielded.

As described above in particular, the intermediate working fluid of the bottoming cycle is different from the $CO_2$ (or from the working fluid of the topping cycle) and preferably is a gas or a gas mixture selected from the group comprising: hydrocarbons, nitrogen, $CO_2$ and coolants.

As described above, the working fluid may be $CO_2$; alternatively, a working fluid may be employed mainly consisting of $CO_2$ but with the addition of hydrocarbon/additive mixtures which allow this fluid to be liquefied at higher temperatures than the ambient temperature or than the one of the available cold fluid.

According to an aspect of the invention, a further superheating step of said fluid to be regasified may be conducted after step 7).

More in detail, such a further step is carried out by means of a low-temperature heat source.

For the purposes of the present invention, the described process may further comprise a step of regulating the circulating mass flow of $CO_2$ in the cycle, where the $CO_2$ is kept at the liquid state (also by virtue of the frigories provided by the cold source, and pressurized).

For this purpose, the system may comprise a $CO_2$ storage tank.

Such an adjustment advantageously allows the power of the cycle to be regulated.

Figure 2C:
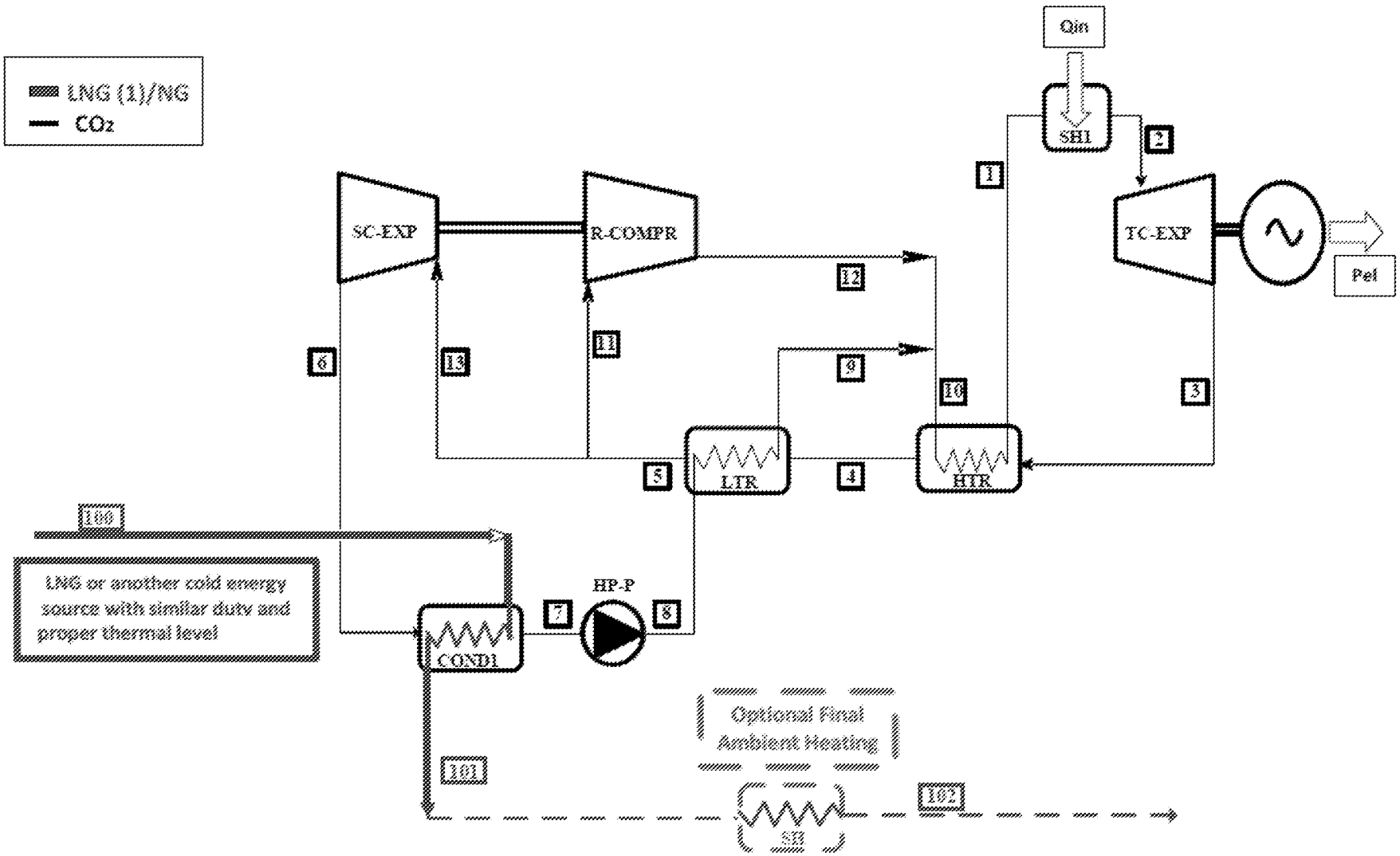

In one aspect of the present invention depicted for example, in FIG. 2C, there may be provided a configuration of the turbomachinery, i.e. of the transcritical turbine, of the recompressor and of the subcritical turbine, whereby the pressure of end transcritical expansion may be suitably set so that it actuates the generator, while the subcritical turbine actuates the recompressor; such a configuration has the advantage of simplifying the system.

According to another aspect of the present invention not shown in the Figures, the turbine may actuate the low-pressure pump and/or the high-pressure pump.

According to a second object of the present invention, there is described a regasification line for a fluid, preferably the liquefied natural gas (LNG) which allows producing electrical energy by means of the above-described process.

An LNG regasification system comprising one or more regasification lines is also an object of the present invention.

The term "regasification line" means that independent and replicable portion of the system that includes the structures, the equipment, the machinery and the systems for regasifying a given flow of the liquefied natural gas (LNG).

Such structures, equipment, machinery and systems in particular originate from the tank (TANK) in which the LNG is stored, comprise cryogenic pumps, possibly low- and high-pressure pumps and a BOG compressor, which may be common to several regasification lines, and a regasification section, and end with the regasified LNG introduction point into the distribution network of the gas itself.

For the purposes of the present invention, the regasification section is the condenser inside of which the condensation step 7) of the working fluid occurs, according to the above-described process.

Alternatively, a regasification line of the present invention may be provided in energy by-pass configuration with respect to a traditional technology of an existing system.

Figure 3:
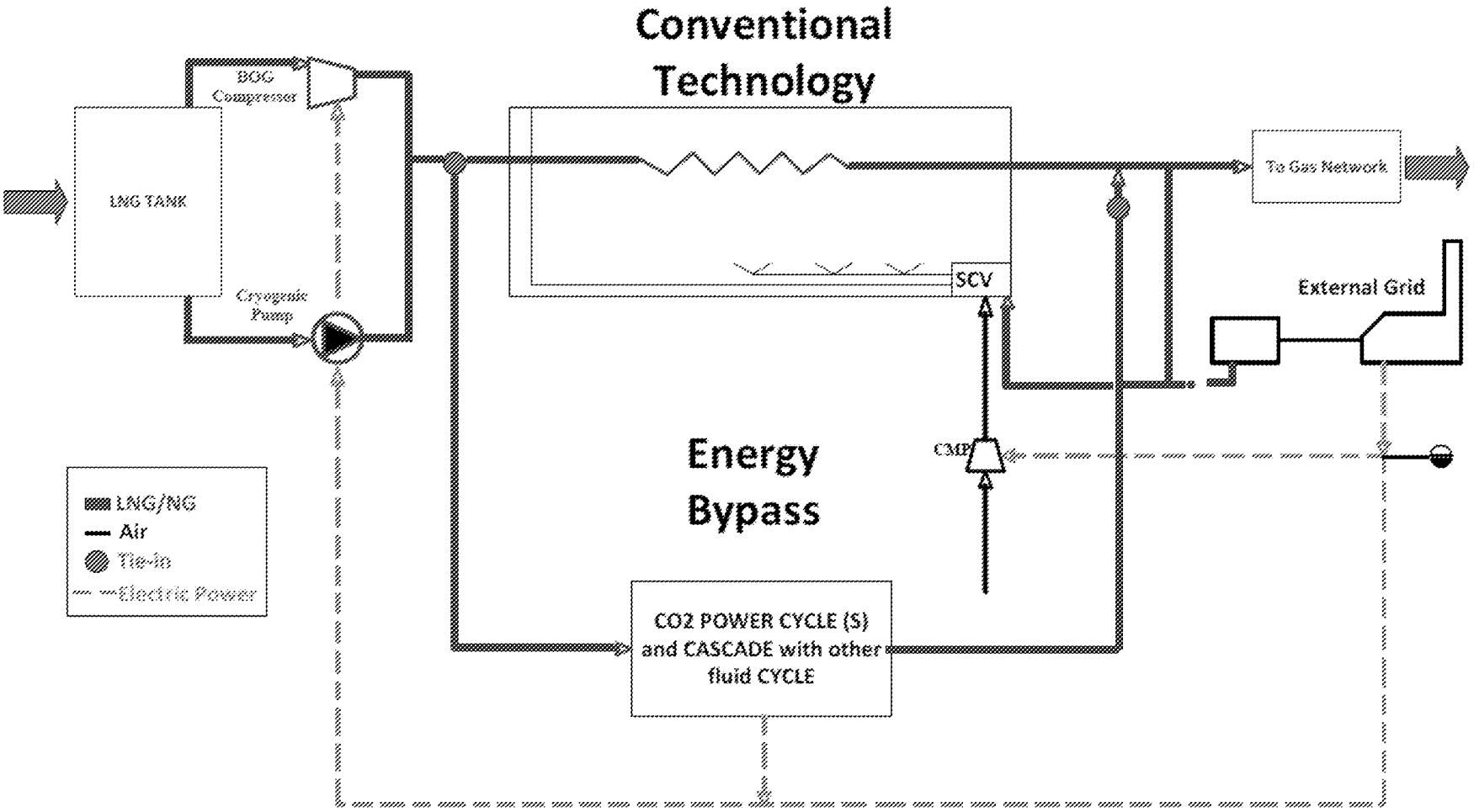
FIG. 3 shows the diagram of an LNG regasification system which was modified by applying the technology of the present invention.

As shown in FIG. 3, the condensation step 7) is carried out on a portion of the liquefied natural gas flow LNG, while the remaining portion of LNG may be subjected to vaporization in a vaporization section according to the background art.

According to an alternative embodiment of the present invention, the process described may be integrated with a conventional technology of SCV type.

Here, a coil containing condensing $CO_2$ or a suitable fluid (such as, for example water-glycol) which exchanges heat with the condensing $CO_2$ heats the vaporization bath.

The layouts proposed may also be applied for making systems for regasifying technical gas (such as, for example hydrogen, air, nitrogen or other gas) or systems with low- or cryogenic-temperature fluid storages, also for cryogenic depots or storages.

When an export of electrical energy is not provided, to balance out the electric and heat loads, the power cycle may operate on a fraction of the LNG, regasifying the remaining fraction of LNG, with other systems and/or employing the surplus of electric power to feed air heating technologies.

The values indicated in the following section refer to a reference regasification system by way of explanation but are in any case valid if considered as specific/unitary value. Further, the results obtained in terms of extractible net electric power and thermodynamic efficiency of the cycle refer to a pressure of 100 to 250 or 150 to 350 bar and beyond A, and at a temperature of about 350° C. to 550° C. or 450° C. to 650° C., up to 700° C. and beyond, at the transcritical expansion turbine input, where applicable.

Please note the reference diagram in FIG. 2A (recompressing with subcritical post-expanding without the use of ambient heating means for regasifying the LNG flow).

$CO_2$ Circuit

The fluid cooled by the two heat exchangers (HTR and LTR) (5) is divided into two flows, one of which is sent (13) to a further expander (SC EXP) and is expanded at a variable pressure between 8 and 45 bar (6) prior to being sent to condenser COND1, thus extracting an overall increased work (TC EXP and SC EXP). By condensing at a lower pressure with respect to the diagram in FIG. 1, the temperature of the $CO_2$ output from the condenser (COND1) is comprised between −50° C. and 5° C. (7). Therefore, liquid $CO_2$ is pumped through the pump (HP-P) at the initial pressure greater than 150 bar (8) and then preheated at a maximum temperature of about 200° (9) through the first heat exchanger (LTR). The second flow (11) sent to the recompressor (R-COMPR) to be compressed at a pressure greater than 150 bar (12). This flow, which is output from the recompressor, rejoins with the one (9) from the first heat exchanger (LTR) and is sent to the second heat exchanger (HTR) (10) to be further heated. The main results are: a net electric power up to 35.3 MWe and thermodynamic performance of the cycle up to 60%, employing a total circulating $CO_2$ of 603.2 t/h.

As described above, there may be the option of configuring turbomachinery (FIG. 2C) in which the project of the turbomachinery may be simplified by suitably setting the transcritical end expanding pressure (TC-EXP) in (3), where the transcritical turbine (TC-EXP) actuates the generator while the subcritical turbine (SC-EXP) actuates the recompressor (R-COMPR).

Liquefied Natural Gas (LNG) Circuit 123.61 t/h of LNG are drawn at the temperature of −156.6° C. and at a pressure of 90.5 bar A (100). Then, LNG receives heat in COND 1 (24.34 MWt), reaching the temperature of 2.5° C. (101).

Note the same reference diagram in FIG. 2A (recompressing with subcritical post-expanding) with the option considering also the use of an ambient heating means for regasifying the LNG flow.

LNG is not entirely regasified, i.e. up to a temperature of 2.5° C., by means of the condensation of the power cycle. The remaining portion is regasified through an ambient means, which, in the case described below, corresponds to seawater. The difference between the two diagrams is indicated by a dotted line (FIG. 2A).

$CO_2$ Circuit

With respect to a diagram similar to the one in FIG. 2A but which does not provide using ambient means, in addition to the extensive properties (e.g. flows, split at recompressing), the main differences consist of the expansion pressures being different; in particular, the pressure prior to the condensation of the $CO_2$ which is as low as possible, compatibly with the formation of carbon dioxide in the solid state and therefore, at the limit of 8.318 bar, corresponding to −45° C. (in general and at the maximum percentage of mass of liquid output from the subcritical expander (equal to about 10%). The supercritical expansion pressure instead occurs up to the compatible pressure with the maximum temperature allowed at the discharge of the recompressing (200° C.). An increased thermodynamic efficiency of the cycle is obtained, which however requires the addition of a system for heating the LNG through an ambient means or equivalent source with the related circuit. The main results are: a net electric power up to 27.5 MWe and electric performance up to 63.4%, employing a total circulating $CO_2$ of 421.5 t/h.

Liquefied Natural Gas (LNG) Circuit

The output temperature of the natural gas (LNG regasifying) is lower given that it is heated with the $CO_2$ cycle through the same condenser (COND 1) with a variable reached temperature between −55° C. and 0° C. (101). Therefore, a further superheating fluid is required to heat the natural gas at the required temperature, included between 0 and 10° C. (in the particular case: 2.5° C.). For this purpose, the natural gas is sent into an ambient air cooler or into an optional seawater circuit SH (102).

With respect to the diagram in FIG. 2A without the dotted section, LNG is not entirely vaporized up to the temperature of 2.5° C. through the heat exchange with the $CO_2$ in COND1. The following description is consistent with the balance indicated above.

$CO_2$ Circuit 123.61 t/h of LNG are drawn at the temperature of −156.6° C. and at a pressure of 90.5 bar A (100). Then, LNG receives heat (16.53 MWt if, as indicated above, the pressure CO2 circuit side to the flow (3) is equal to 45 bar) in COND1 up to reaching a temperature of −50° C. (101). The remaining part of the vaporization, which is dependent on the preceding heat exchange in COND1, is completed in heater SH where the LNG receives heat from the seawater circulating in a dedicated circuit and reaches a temperature of 2.5° C. (102).

Seawater Circuit

The seawater circuit (not shown) completes the vaporization of the LNG from the temperature reached in COND1 through the heat exchange with the $CO_2$ and up to the temperature of 2.5° C. in series at COND 1.

With reference to the same example indicated above and described in the sub-sections "$CO_2$ Circuit" and "LNG Circuit", 1340.1 t/h of seawater at the temperature of 9° C. and at atmospheric pressure are drawn at the seawater intake and pumped at the pressure of about 2 bar A by means of a pump. The flow is then fed to heater SH (7.82 MWt) where it is cooled by 5° C. and discharged into the sea, thus allowing the vaporization of the LNG from the temperature obtained at the output of COND1 up to reaching a temperature of 2.5° C., which is not obtainable with condenser COND1 alone.

FIG. 2B shows the diagram of the alternative embodiment which provides a topping cycle, which does not directly exchange heat/frigories with the LNG flow, rather by virtue of a bottoming cycle, the details of which are not shown in the Figures. The circulating intermediate working fluid in the bottoming cycle is different from the $CO_2$ but allows the $CO_2$ of the topping cycle to be condensed and, simultaneously, the LNG to be regasified is condensed. This allows increasing the overall efficiency, also through an increased adherence in COND2 of the condensation curve of the intermediate working fluid circulating in the bottoming cycle at the vaporization curve of the LNG to be regasified. This is obtained to the detriment of an increased engineering complexity.

The advantages offered by the present invention are apparent to a person skilled in the art from the description above.

Considering the conventional regasifying technologies, the main advantages of the solution appear to be:

- reduction of the consumption of fuel gas with respect to SCV technology, the advantage expressed in terms of Fuel Gas Saving (FGS)=(Gas cycle consumption−SCV or ORV consumption/SCV or ORV consumption) [%] up to 60% (30%) with energy surplus availability;
- reduction of $CO_2$ emissions up to 60% (30%), (proportionately to the reduction of the fuel gas consumption, with respect to a conventional SCV and ORV technology);
- the production of electrical energy may be employed to meet the system needs and for exporting the same;
- specific technical problems are avoided or significantly reduced both for the above-mentioned ORV and for SCV;
- all the advantages associated with the employment of carbon dioxide as working fluid can be exploited: low freezing point, stability.

Further, more in detail, the following was positively noted:

- the availability of a cold well, represented by the LNG or other technical gas to be regasified or by a storage at low or cryogenic temperatures, which allows the $CO_2$ to be liquefied at different pressures, thus obtaining (Brayton-Rankine) transcritical $CO_2$ power generating cycles, with significantly greater efficiency than $CO_2$ (supercritical) Brayton cycles;
- the employment of a pump for compressing condensed $CO_2$ allows a reduction of the power required by the cycle and of the system cost to be obtained with respect to the employment of the primary compressor required in the supercritical $CO_2$ Brayton cycles;
- engineering simplicity, especially for retrofitting existing systems; $CO_2$ power cycle may be integrated in a conventional SCV technology, as described above;
- the possibility of including a $CO_2$ storage tank (not depicted in the Figures) allows the power of the cycle to be regulated by regulating the mass flow circulating in the cycle, where $CO_2$ is kept in the liquid state also by virtue of the frigories provided by the cold source, and pressurized: this allows a given operating flexibility to be obtained also in the startup and stop steps and in potential emergency scenarios; and it simplifies the design of the storage tank, which may operate at lower pressures and with smaller volumes.

With respect more specifically to $CO_2$ transcritical power generating cycles, the following advantages can be acknowledged:

- $CO_2$ transcritical power generating cycles allow the expansion from high pressures in supercritical step to low pressures in subcritical step, under condition of condensing the $CO_2$ at low temperatures, using LNG or a fluid with adequate thermal level as a cold well, by means of one or more expansion turbines, exploiting the specific high work of the fluid at high pressures: by allowing an increased expansion ratio of the turbines, this generates sufficient power to feed the utilities of the LNG regasification system or also a surplus of generated electric power available to feed possible external utilities;
- the optimization of the transcritical $CO_2$ cycle allows an increased share of frigories available during the LNG vaporization to be used, and drastically reduces the consumption of energy required to regasify LNG.

With reference to the drawings in FIGS. 2A and 2B in particular:

- given that the division of the flow occurs downstream of the condensation step, all the working fluid exchanges heat/frigories with the LNG; therefore the embodiment is best adapted to regasifying the LNG with respect to others, thus obtaining an increased thermodynamic efficiency and a decreased circulation in the power cycle, with an increased specific work, which potentially reduces the sizes of the system and its consumption of fuel gas (the net extractible power however is less due to the smaller circulating flow);
- the first pumping at an intermediate pressure makes available a fraction of the working fluid at the most suitable pressure for the recompressing, thus allowing the recompressing in a turbomachine alone, limiting the compression ratio, and together with the LTR, best exploiting the available low-temperature thermal source.

With reference to the diagram in FIG. 2B, in particular:

- this cycle may be employed as topping cycle of a cascade configuration with a bottoming cycle which in turn regasifies the LNG.

Overall, the cascade power generating cycles may be combined so as to best exploit the features and constraints thereof to the advantage of regasifying the LNG, thus improving the employment of the frigories (vaporization curve). Although they have increased engineering complexity, they allow the overall system efficiency to be improved.

In the case of a $CO_2$ topping cycle and a bottoming cycle with fluid different from $CO_2$ as described above:

the condensation of the $CO_2$ is carried out by means of the vaporization of the fluid in the bottoming cycle which occurs at temperatures which are compatible with the solidification of the $CO_2$ and which condenses, recuperating the LNG frigories with a more efficient LNG vaporization curve and the possibility of recuperating all the frigories available in the LNG;

the addition of the topping cycle allows the extraction of increased power with respect to the system with only bottoming cycle and the possibility of best exploiting the available heat sources, especially if at high temperature, thus allowing the recuperation of this heat to be distributed between the two cycles; in particular, the range of condensation temperatures of the $CO_2$ (comprised between the triple point at −56.56° C. and the critical temperature of +30.98° C.) allows a bottoming cycle with organic fluid to be coupled in an optimal manner to one of the innovative $CO_2$ cycles proposed in this paper and the pressure jumps in the two-cycle turbines to be optimized.

Further, the $CO_2$ topping cycle is a supercritical/transcritical cycle with recovery unit and recompressor, therefore the energy available at high temperature is exploited well in a high efficiency topping cycle, instead designating the energy at lower temperatures (the one discharged from the topping cycle) to the ORC bottoming cycle. The two cascade cycles ($CO_2$ topping cycle and ORC bottoming cycle) are optimized with the heat inputs in the temperature ranges appropriate thereto, with benefits to the overall efficiency and simplification in designing the turbomachinery.

All the embodiments of the invention may operate in configuration both of energy by-pass at a conventional regasifying technology for an existing system (such as for example, shown in FIG. 3), with the advantage of making the system more efficient through a retrofit, increasing the flexibility and availability thereof, and as replacement of the conventional technology in the case of a new system and/or as an alternative system, with the advantage of obtaining an increased system production ("de-bottlenecking").

What is claimed is:

1. A process for regasifying a fluid and producing electrical energy, said process comprising subjecting a flow of a working fluid to the steps of:

1) high-pressure pumping,
2) heating in a recovery unit, thus obtaining a heated flow, said heating step comprising a low-temperature heat recovery step 2a) and a high-temperature heat recovery step 2b),
3) further heating, thus obtaining a further heated flow,
4) expanding in a turbine, with production of electrical energy, thus obtaining an expanded flow,
5) cooling in a recovery unit by heat exchange, in a step 5a) with the flow of step 2b) and in a step 5b) with the flow of step 2a), thus obtaining a cooled flow,
6) expanding with production of mechanical energy, and
7) condensing said flow of the working fluid and regasifying said flow, wherein, after step 5), a portion of the flow of said working fluid is not subjected to step 6) but is subjected to a recompressing step.

2. The process of claim 1, wherein a recompressed flow of said working fluid is obtained from the recompressing step, which is joined to the flow of the working fluid obtained from step 2a).

3. The process of claim 1, wherein step 3) is carried out by a high-temperature heat source.

4. The process of claim 1, wherein step 7) is carried out by heat exchange with said fluid to be regasified.

5. The process of claim 1, wherein step 7) is carried out by indirect heat exchange by an intermediate working fluid, which acquires heat in step 7) and gives heat to said fluid to be regasified in a subsequent step.

6. The process of claim 1, wherein a step of superheating said fluid to be regasified is carried out after step 7).

7. The process of claim 6, wherein said superheating step is carried out by a low-temperature heat source.

8. A liquefied natural gas (LNG) regasification line comprising a regasification section, wherein step 7) of a process for reqasifyinq a fluid and producing electrical energy, said process comprising subjecting a flow of a working fluid to the steps of:

1) hiqh-pressure pumping,
2) heating in a recovery unit, thus obtaining a heated flow, said heating step comprising a low-temperature heat recovery step 2a) and a high-temperature heat recovery step 2b),
3) further heating, thus obtaining a further heated flow,
4) expanding in a turbine, with production of electrical energy, thus obtaining an expanded flow,
5) cooling in a recovery unit by heat exchange, in a step 5a) with the flow of step 2b) and in a step 5b) with the flow of step 2a), thus obtaining a cooled flow,
6) expanding with production of mechanical energy, and
7) condensing said flow of the working fluid and regasifying said flow, wherein, after step 5), a portion of the flow of said working fluid is not subjected to step 6) but is subjected to a recompressing step, is carried out in said regasification section.

9. A liquefied natural gas (LNG) regasification system, comprising one or more regasification lines according to claim 8.

* * * * *